US008659534B2

(12) United States Patent
Kim et al.

(10) Patent No.: US 8,659,534 B2
(45) Date of Patent: Feb. 25, 2014

(54) BACKLIGHT DRIVING APPARATUS

(75) Inventors: Pu Jin Kim, Gyeongsangbuk-do (KR); Seung Hyun Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1578 days.

(21) Appl. No.: 11/894,833

(22) Filed: Aug. 22, 2007

(65) Prior Publication Data

US 2008/0136769 A1 Jun. 12, 2008

(30) Foreign Application Priority Data

Sep. 12, 2006 (KR) ..... 10-2006-0087849

(51) Int. Cl.
*G09G 3/36* (2006.01)

(52) U.S. Cl.
USPC ..... 345/102; 345/84; 345/87; 345/103

(58) Field of Classification Search
USPC ..... 345/102; 323/315–317
See application file for complete search history.

(56) References Cited

U.S. PATENT DOCUMENTS 3,936,725 A * 2/1976 Schneider ..... 323/315
7,864,142 B2 * 1/2011 Tanahashi et al. ..... 345/82
2005/0276294 A1 * 12/2005 Crawford et al. ..... 372/38.02

* cited by examiner

*Primary Examiner* — Sumati Lefkowitz
*Assistant Examiner* — Jesus Hernandez
(74) *Attorney, Agent, or Firm* — Brinks Gilson & Lione

(57) ABSTRACT

A backlight driving apparatus is disclosed which is capable of simplifying a circuit configuration for driving of a plurality of light emitting diode arrays and making the current balance of the light emitting diode arrays uniform. The backlight driving apparatus includes n light emitting diode arrays that include a plurality of light emitting diodes connected in series, a power source for generating a driving current, a current generator for generating currents to drive the light emitting diode arrays using the driving current, respectively, and a current mirror circuit for allowing substantially the same amount of currents to flow respectively through the light emitting diode arrays based on current from any one of the n light emitting diode arrays.

7 Claims, 15 Drawing Sheets

BACKLIGHT DRIVING APPARATUS

This application claims the benefit of Korean Patent Application No. 10-2006-0087849, filed on Sep. 12, 2006, which is hereby incorporated by reference as if fully set forth herein.

BACKGROUND OF THE INVENTION

1. Field of the Invention

The present invention relates to a backlight, and more particularly, to a backlight driving apparatus which is capable of simplifying a circuit configuration for driving of a plurality of light emitting diode arrays and making the current balance of the light emitting diode arrays uniform.

2. Discussion of the Related Art

Generally, a liquid crystal display (LCD) device is comprised of an LCD panel which includes a plurality of liquid crystal cells arranged in a matrix configuration, and a plurality of control switches to switch video signals supplied to the respective liquid crystal cells; and a backlight unit to emit light to the LCD panel. The LCD device displays desired images on a screen by controlling the transmittance of light.

The backlight unit is in trend of miniaturization, thin profile and lightness in weight. Following this trend of backlight unit, a light-emitting diode (LED) replaces a fluorescent lamp since the LED is advantageous in power consumption, weight and luminance.

FIG. 1 shows a schematic view of a general backlight driving apparatus.

Referring to FIG. 1, the general backlight driving apparatus includes a plurality of light emitting diode (LED) arrays 101 to 10*n*, and a plurality of power sources 201 to 20*n* for generating a plurality of driving currents to drive the LED arrays 101 to 10*n*, respectively.

The power sources 201 to 20*n* generates the driving current using an external input voltage Vin in response to control signals from a plurality of controllers (not shown), respectively.

Each of the LED arrays 101 to 10*n* includes a plurality of LEDs (L1 to Lm) connected in series between each of the power sources 201 to 20*n* and a ground voltage source.

The LEDs (L1 to Lm) of each LED array are lighted by current supplied from each of the power sources 201 to 20*n*.

The above-mentioned general backlight driving apparatus is disadvantageous in that the plurality of power sources 201 to 20*n* and the plurality of controllers must be provided to drive the plurality of LED arrays 101 to 10*n*, respectively, resulting in a complexity in circuit configuration and an increase in cost.

Moreover, in the general backlight driving apparatus, there is no uniformity in the balance of currents which are supplied from the plurality of power sources 201 to 20*n* to the plurality of LED arrays 101 to 10*n*, respectively.

SUMMARY OF THE INVENTION

Accordingly, the present invention is directed to a backlight driving apparatus that substantially obviates one or more problems due to limitations and disadvantages of the related art.

An object of the present invention is to provide a backlight driving apparatus which is capable of simplifying a circuit configuration for driving of a plurality of light emitting diode arrays and making the current balance of the light emitting diode arrays uniform.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a backlight driving apparatus comprises: n light emitting diode arrays including a plurality of light emitting diodes connected in series; a power source for generating a driving current; a current generator for generating currents to drive the light emitting diode arrays using the driving current, respectively; and a current mirror circuit for allowing the same amount of currents to flow respectively through the light emitting diode arrays based on current from any one of the n light emitting diode arrays.

In another aspect of the present invention, a backlight driving apparatus comprises: n light emitting diode arrays including a plurality of light emitting diodes connected in series; a power source for generating a driving current; a current generator for generating n currents to drive the light emitting diode arrays using the driving current, respectively; a base current generator for generating n base currents using current from any one of the n light emitting diode arrays; and a current mirror circuit for allowing the same amount of currents to flow respectively through the light emitting diode arrays based respectively on the base currents.

In another aspect of the present invention, a backlight driving apparatus comprises: n light emitting diode arrays including a plurality of light emitting diodes connected in series; a power source for generating a driving current and supplying the generated driving current in common to the light emitting diode arrays; a current generator for generating n currents using current flowing through any one of the n light emitting diode arrays; and a current mirror circuit for allowing the same amount of currents to flow respectively through the light emitting diode arrays based respectively on the n currents.

In yet another aspect of the present invention, a backlight driving apparatus comprises: n light emitting diode arrays each including a plurality of light emitting diodes connected in series; a power source for generating a driving current and supplying the generated driving current in common to the light emitting diode arrays; a current mirror circuit for allowing the same amount of currents to flow respectively through the light emitting diode arrays based on current from any one of the n light emitting diode arrays; and a current compensator connected to the current mirror circuit for compensating for a difference among the amounts of currents flowing respectively through the light emitting diode arrays.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts. In the following description of the present invention, a detailed description of known functions and configurations incorporated herein will be omitted when it may make the subject matter of the invention rather unclear.

Figure 1:
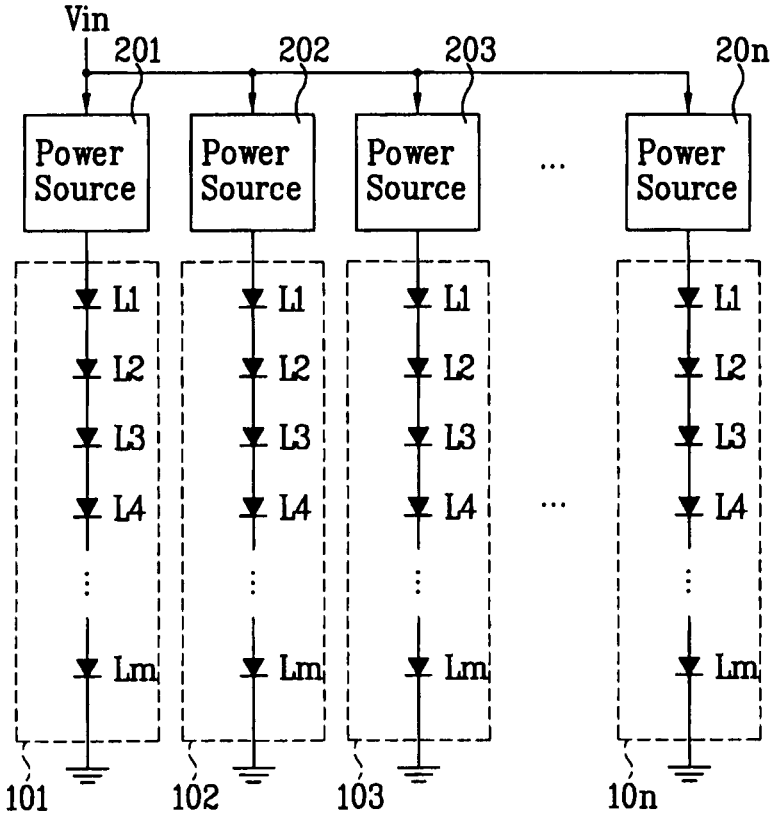
FIG. 1 Related Art
FIG. 1 is a schematic view of a general backlight driving apparatus.
Figure 2:
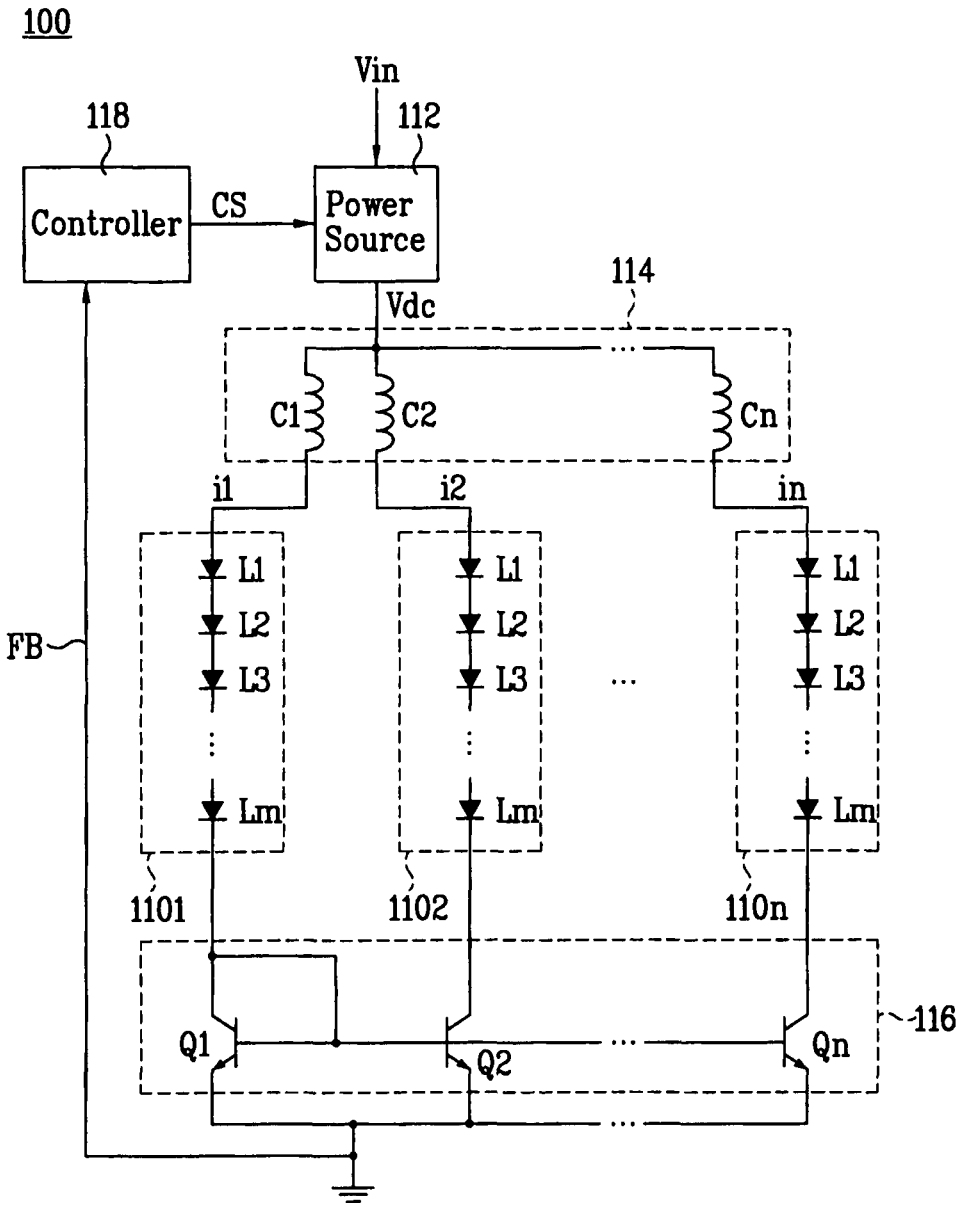
FIG. 2 is a schematic view of an embodiment of a backlight driving apparatus according to a first embodiment.

FIG. 2 is a schematic view of an embodiment of a backlight driving apparatus according to a first embodiment.

Referring to FIG. 2, the backlight driving apparatus 100 according to the first embodiment includes first to nth light emitting diode (LED) arrays 1101 to 110*n* each including a plurality of LEDs (L1 to Lm) connected in series, a power source 112 for generating a driving current Vdc, a current generator 114 for generating first to nth currents (i1 to in) to drive respectively the LED arrays 1101 to 110*n* using the driving current Vdc, a current mirror circuit 116 connected between the LED arrays 1101 to 110*n* and a ground voltage source for allowing the same amount of currents to flow respectively through the LED arrays 1101 to 10*n*, and a controller 118 for controlling the power source 112 based on a feedback signal outputted from the current mirror circuit 116.

The power source 112 generates the driving current Vdc using an input voltage Vin in response to a control signal CS from the controller 118.

The current generator 114 includes first to nth choke coils (C1 to Cn) connected in common to an output terminal of the power source 112 and respectively to one ends of the LED arrays 1101 to 110*n*.

The first to nth choke coils (C1 to Cn) may have the same turn ratio or different turn ratios to supply the same amount of currents to the LED arrays 1101 to 110*n*, respectively.

With this configuration, the current generator 114 supplies the first to nth currents (i1 to in) which are the same in amount, respectively, to the LED arrays 1101 to 110*n* by compensating for an impedance difference among the LED arrays 1101 to 110*n* using the choke coils (C1 to Cn).

The plurality of LEDs (L1 to Lm) of each of the LED arrays 1101 to 110*n* are connected in series between each of the choke coils (C1 to Cn) of the current generator 114 and the current mirror circuit 116. The LEDs (L1 to Lm) of each LED array are lighted by the currents (i1 to in) from the current generator 114.

The current mirror circuit 116 includes first to nth mirror transistors (Q1 to Qn) each connected between the other end of the LED arrays 1101 to 110*n* and the ground voltage source.

The base terminals of the first to nth mirror transistors (Q1 to Qn) are connected in common to the other end of the first LED array 1101. The collector terminals of the first to nth mirror transistors (Q1 to Qn) are connected to the other ends of the LED arrays 1101 to 110*n*, respectively. The emitter terminals of the first to nth mirror transistors (Q1 to Qn) are connected in common to the ground voltage source. Preferably, the first to nth mirror transistors (Q1 to Qn) are formed by the same process such that they have the same size and the same channel aspect ratio W/L to form a current mirror.

These first to nth mirror transistors (Q1 to Qn) are turned on by a voltage supplied to the first LED array 1101 to equalize the amounts of currents flowing respectively through the LED arrays 1101 to 110*n*.

The controller 118 generates a control signal (CS) to control the power source 112 by the feedback of current flowing to the ground voltage source from each of the first to nth mirror transistors (Q1 to Qn) through a feedback line FB connected in common to the emitter terminals of the first to nth mirror transistors (Q1 to Qn), and controls the current flowing to the respective LED arrays 1101 to 110*n* to a constant value. As a result, the driving current Vdc from the power source 112 varies with the control signal CS from the controller 118.

As described above, the backlight driving apparatus 100 according to the first embodiment can drive the plurality of LED arrays 1101 to 110*n* with one controller 118 and one power source 112 by supplying currents to the LED arrays 1101 to 110*n*, respectively, using the choke coils (C1 to Cn) and the mirror transistors (Q1 to Qn).

Therefore, the backlight driving apparatus 100 according to the first embodiment is capable of simplifying the circuit configuration to drive the plurality of LED arrays 1101 to 110*n* and making the current balance of the LED arrays 1101 to 110*n* uniform.

Figure 3:
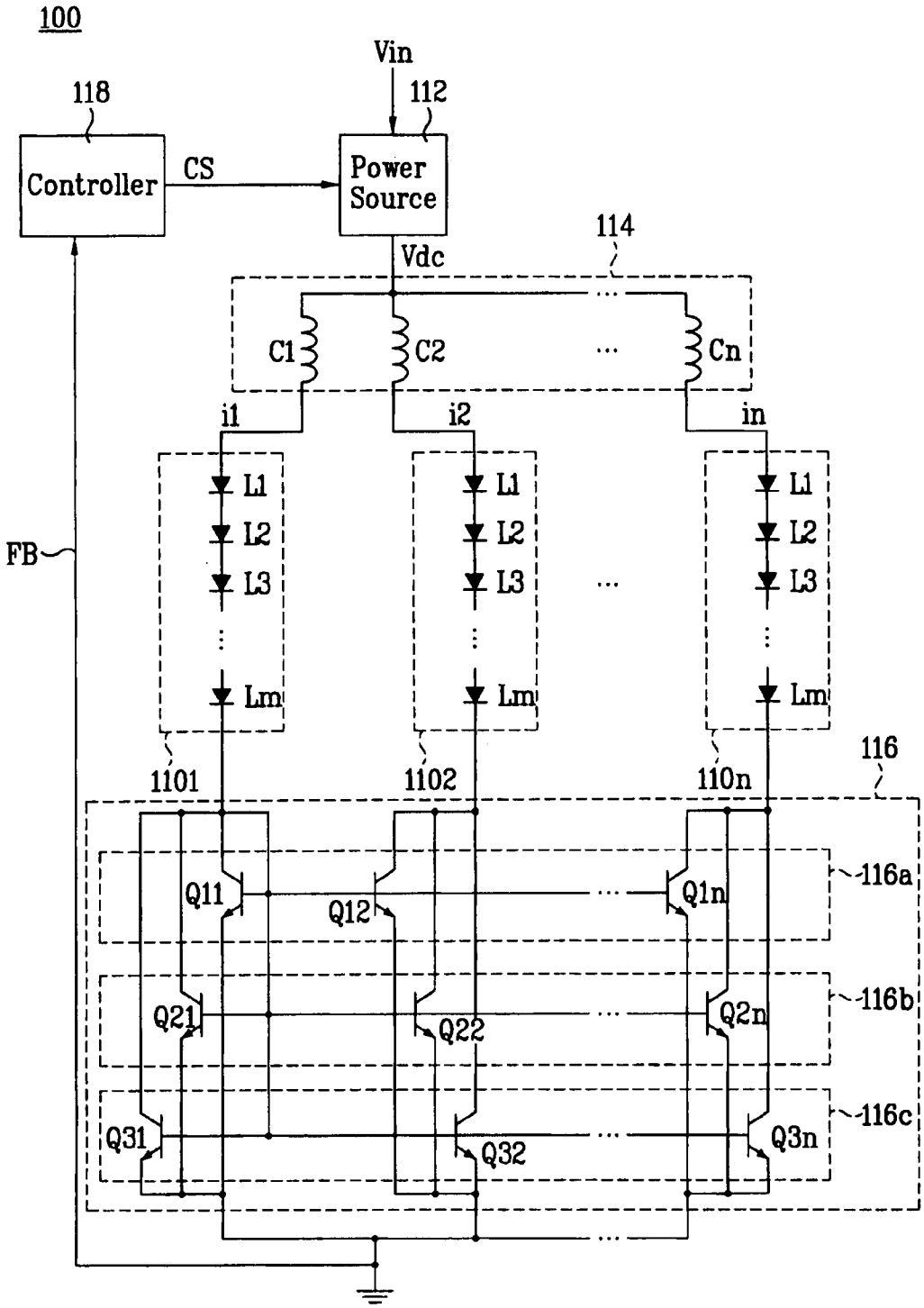
FIG. 3 is a schematic view of another embodiment of the backlight driving apparatus according to the first embodiment.

Alternatively, in the backlight driving apparatus 100 according to the first embodiment, the current mirror circuit 116 may include first to third current mirrors 116*a*, 116*b* and 116*c* connected between the LED arrays 1101 to 110*n* and the ground voltage source, as shown in FIG. 3.

The first current mirror 116*a* includes n first mirror transistors (Q11 to Q1*n*) controlled by current flowing through the first LED array 1101 and each connected between the other end of the LED arrays 1101 to 110*n* and the ground voltage source.

The base terminals of the n first mirror transistors (Q11 to Q1*n*) are connected in common to the other end of the first LED array 1101. The collector terminals of the n first mirror transistors (Q11 to Q1*n*) are connected to the other ends of the LED arrays 1101 to 110*n*, respectively. The emitter terminals of the n first mirror transistors (Q11 to Q1*n*) are connected in common to the ground voltage source.

The second current mirror 116*b* includes n second mirror transistors (Q21 to Q2*n*) controlled by the current flowing through the first LED array 1101 and connected in parallel to the n first mirror transistors (Q11 to Q1*n*), respectively.

The base terminals of the n second mirror transistors (Q21 to Q2*n*) are connected in common to the other end of the first LED array 1101. The collector terminals of the n second mirror transistors (Q21 to Q2*n*) are connected to the other ends of the LED arrays 1101 to 110*n*, respectively. The emitter terminals of the n second mirror transistors (Q21 to Q2*n*) are connected in common to the ground voltage source.

The third current mirror 116*c* includes n third mirror transistors Q31 to Q3*n* controlled by the current flowing through the first LED array 1101 and connected in parallel to the n first and second mirror transistors (Q11 to Q1*n*) and (Q21 to Q2*n*), respectively.

The base terminals of the n third mirror transistors (Q31 to Q3*n*) are connected in common to the other end of the first LED array 1101. The collector terminals of the n third mirror transistors (Q31 to Q3*n*) are connected to the other ends of the LED arrays 1101 to 110*n*, respectively. The emitter terminals of the n third mirror transistors (Q31 to Q3*n*) are connected in common to the ground voltage source.

Preferably, the n first to third mirror transistors (Q11 to Q1*n*), (Q21 to Q2*n*) and (Q31 to Q3*n*) are formed by the same process such that they have the same size and the same channel aspect ratio W/L to form current mirrors.

As described above, the current mirror circuit 116 has a multi-structure including the first to third mirror transistors (Q11 to Q1*n*), (Q21 to Q2*n*) and (Q31 to Q3*n*). Therefore, it is possible to equalize the amounts of currents flowing respectively through the LED arrays 1101 to 110*n* by compensating for a difference among current amplification degrees β of the mirror transistors.

Figure 4:
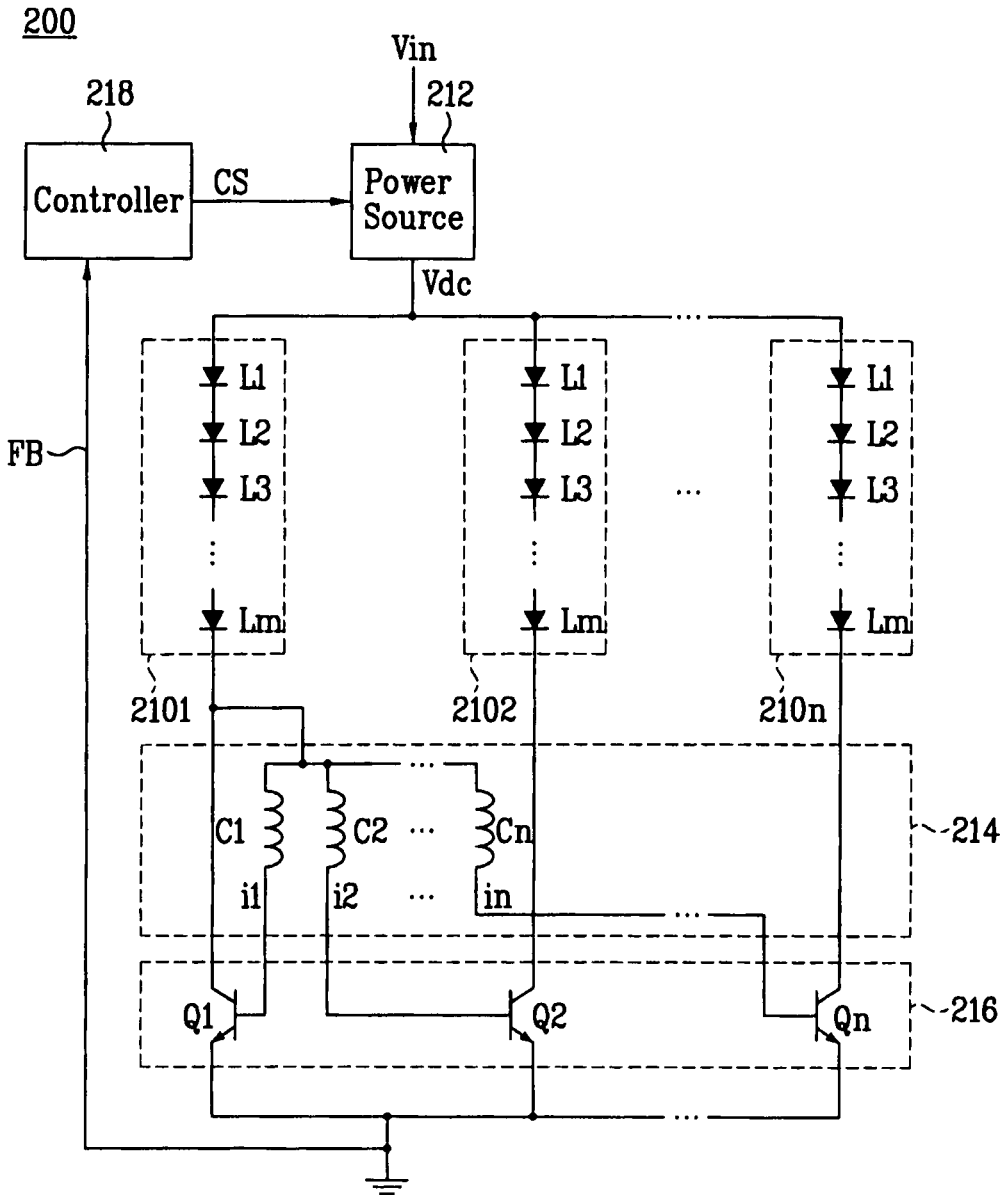
FIG. 4 is a schematic view of an embodiment of a backlight driving apparatus according to a second embodiment.

FIG. 4 is a schematic view of an embodiment of a backlight driving apparatus according to a second embodiment.

Referring to FIG. 4, the backlight driving apparatus 200 according to the second embodiment includes first to nth LED arrays 2101 to 210*n* each including a plurality of LEDs (L1 to Lm) connected in series, a power source 212 for generating a driving current Vdc and supplying the generated driving current Vdc in common to the first to nth LED arrays 2101 to 210*n*, a current generator 214 for generating first to nth currents (i1 to in) using current flowing through the first LED array 2101, a current mirror circuit 216 for allowing the same amount of currents to flow respectively through the LED arrays 2101 to 210*n* based respectively on the first to nth currents (i1 to in), and a controller 218 for controlling the power source 212 based on a feedback signal outputted from the current mirror circuit 216.

The power source 212 generates the driving current Vdc using an input voltage Vin in response to a control signal CS from the controller 218.

The plurality of LEDs (L1 to Lm) of each of the LED arrays 2101 to 210*n* are connected in series between an output terminal of the power source 212 and the current mirror circuit 216. Here, the anode terminals of the first LEDs L1 of the LED arrays 2101 to 210*n* are connected in common to the output terminal of the power source 212. The LEDs (L1 to Lm) of each LED array are lighted by driving current Vdc from the power source 212.

The current generator 214 includes first to nth choke coils (C1 to Cn) connected in common to the other end of the first LED array 2101 and connected to the current mirror circuit 216.

The first to nth choke coils (C1 to Cn) generate the first to nth currents (i1 to in) based on current flowing through the first LED array 2101, respectively.

The current mirror circuit 216 includes first to nth mirror transistors (Q1 to Qn) for equalizing the amounts of currents flowing respectively through the LED arrays 2101 to 210*n* based respectively on the first to nth currents (i1 to in) supplied from the current generator 214.

The base terminals of the first to nth mirror transistors (Q1 to Qn) are connected to the first to nth choke coils (C1 to Cn) of the current generator 214, respectively. The collector terminals of the first to nth mirror transistors (Q1 to Qn) are connected to the other ends of the LED arrays 2101 to 210*n*, respectively. The emitter terminals of the first to nth mirror transistors (Q1 to Qn) are connected in common to the ground voltage source. Preferably, the first to nth mirror transistors (Q1 to Qn) are formed by the same process such that they have the same size and the same channel aspect ratio W/L to form a current mirror.

These first to nth mirror transistors (Q1 to Qn) are turned on by the first to nth currents (i1 to in), respectively, to equalize the amounts of currents flowing respectively through the LED arrays 2101 to 210*n*.

On the other hand, the first to nth choke coils (C1 to Cn) of the current generator 214 may have the same turn ratio or different turn ratios to equalize the amounts of the currents (i1 to in) flowing respectively to the mirror transistors (Q1 to Qn). Therefore, the current generator 214 generates the first to nth currents (i1 to in) based on the turn ratios of the choke coils (C1 to Cn), so as to prevent the currents (i1 to in) flowing respectively to the mirror transistors (Q1 to Qn) from varying due to disturbance.

The controller 218 generates a control signal (CS) to control the power source 212 by the feedback of current flowing to the ground voltage source from each of the first to nth mirror transistors (Q1 to Qn) through a feedback line FB connected in common to the emitter terminals of the first to nth mirror transistors (Q1 to Qn), and controls the current flowing to the respective LED arrays 2101 to 210*n* to a constant value. As a result, the driving current Vdc from the power source 212 varies with the control signal CS from the controller 218.

As described above, the backlight driving apparatus 200 according to the second embodiment can drive the plurality of LED arrays 2101 to 210*n* with one controller 218 and one power source 212 by supplying currents to the LED arrays 2101 to 210*n*, respectively, using the choke coils (C1 to Cn) and the mirror transistors (Q1 to Qn).

Therefore, the backlight driving apparatus 200 according to the second embodiment is capable of simplifying the circuit configuration to drive the plurality of LED arrays 2101 to 210*n* and making the current balance of the LED arrays 2101 to 210*n* uniform.

Figure 5:
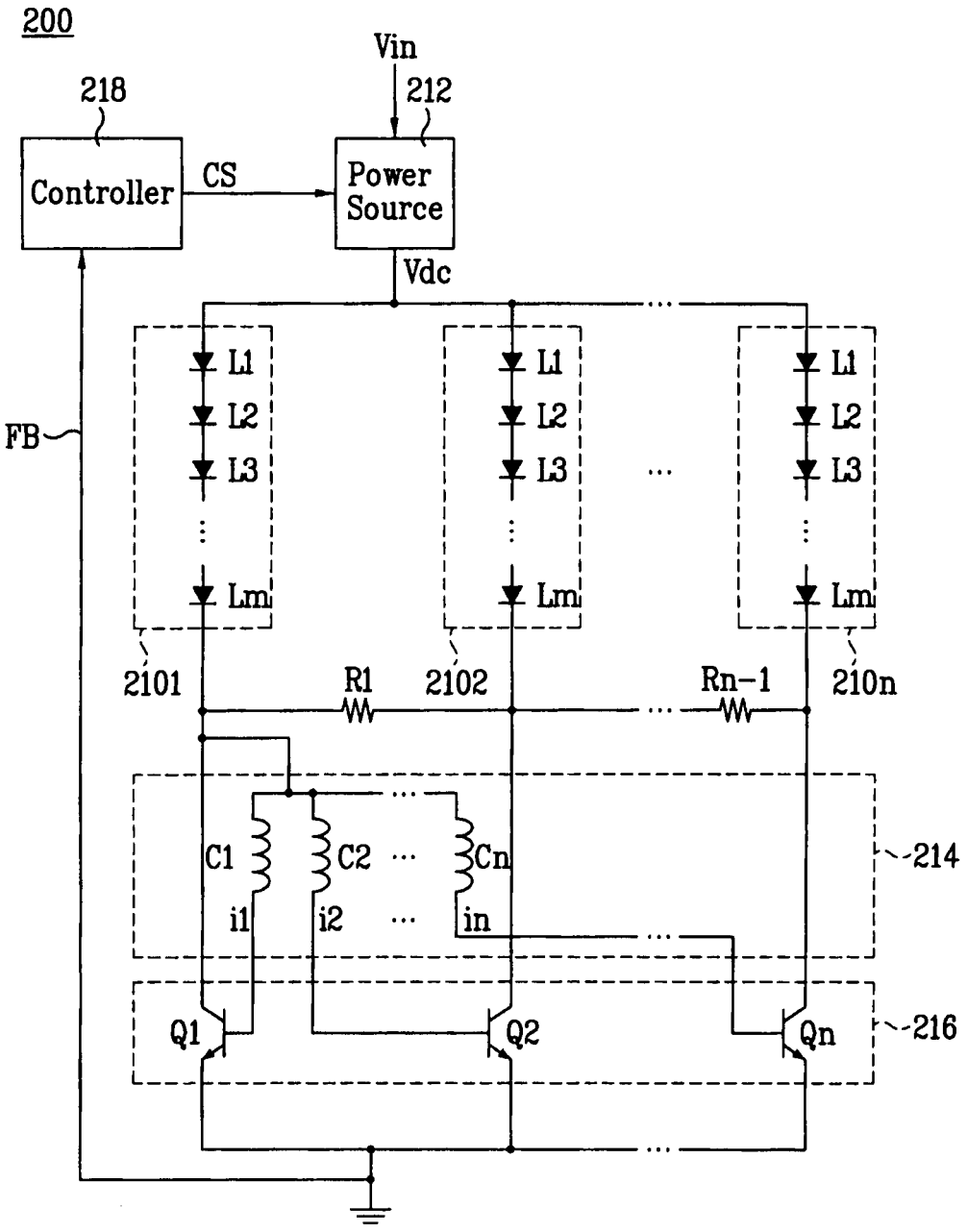
FIG. 5 is a schematic view of another embodiment of the backlight driving apparatus according to the second embodiment.

Alternatively, the backlight driving apparatus 200 according to the second embodiment shown in FIG. 4 may further include first to (n−1)th resistors (R1 to Rn−1) disposed between the LED arrays 2101 to 210*n* and the current generator 214 and each connected between the other ends of adjacent the LED arrays 2101 to 210*n*, as shown in FIG. 5.

Each of the first to (n−1)th resistors (R1 to Rn−1) is connected between the other ends of the adjacent LED arrays to equalize the base voltage and collector voltage of each of the mirror transistors (Q1 to Qn). That is, currents flowing respectively to the mirror transistors (Q1 to Qn) are ideally the same in amount, but actually not so. For this reason, an ideal current mirror formula as in the following equation 1 can be satisfied by equalizing a voltage across each of the resistors (R1 to Rn−1) and a voltage across each of the choke coils (C1 to Cn).

$$\frac{Iout}{Iin} = \frac{1}{1 + 2/\beta} \quad \text{[Equation 1]}$$

In the above equation 1, Iout is output current of a mirror transistor, Iin is input current of the mirror transistor, and β is a current amplification degree of the mirror transistor.

Figure 6:
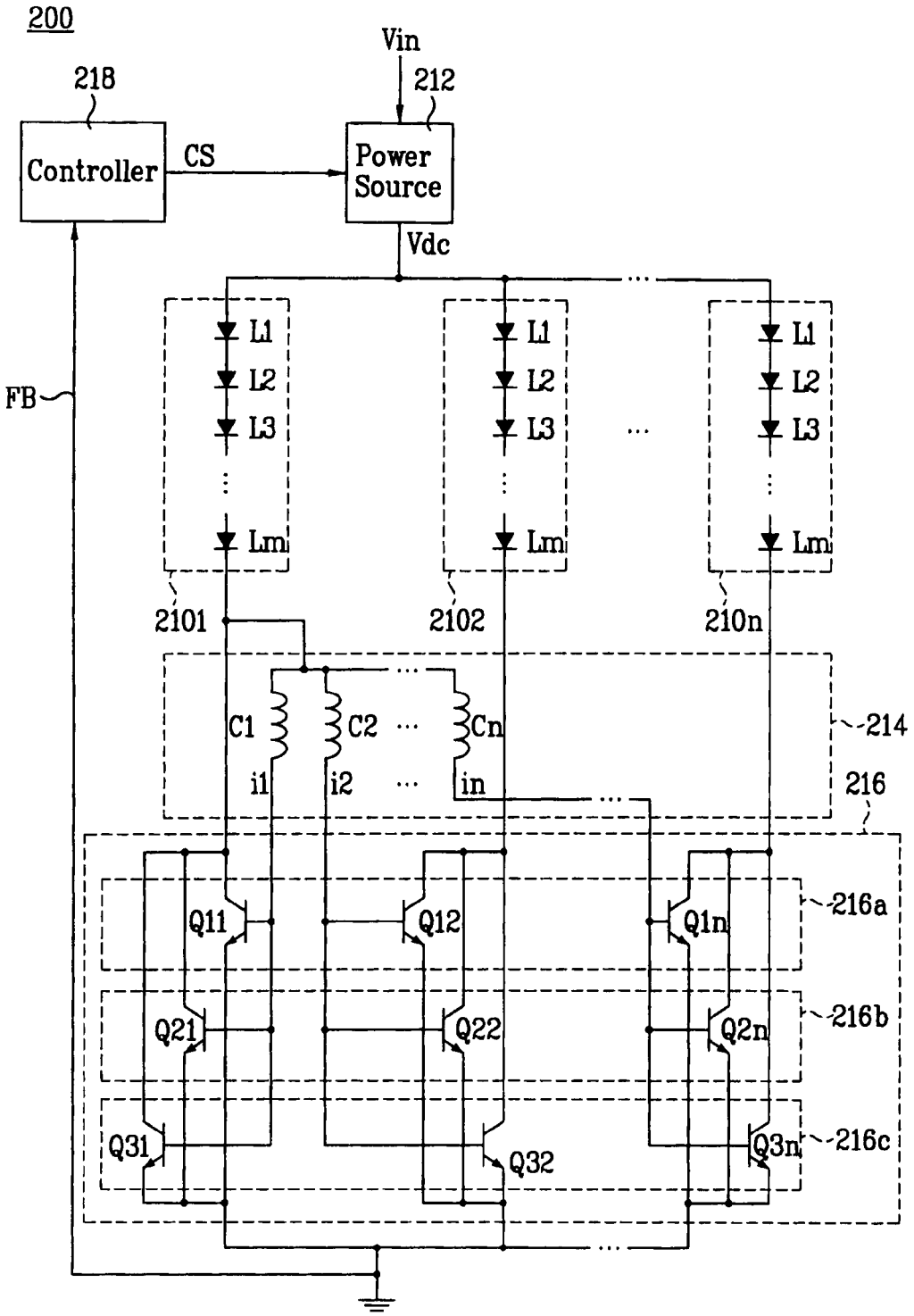
FIG. 6 is a schematic view of another embodiment of the backlight driving apparatus according to the second embodiment.

As another alternative, in the backlight driving apparatus 200 according to the second embodiment shown in FIG. 4, the current mirror circuit 216 may includes first to third current mirrors 216*a*, 216*b* and 216*c* connected between the LED arrays 2101 to 210*n* and the ground voltage source, as shown in FIG. 6.

The first to third current mirrors 216*a*, 216*b* and 216*c* are the same in configuration as the first to third current mirrors 116*a*, 116*b* and 116*c* shown in FIG. 3, with the exception that each of the first to third current mirrors 216*a*, 216*b* and 216*c* is controlled by the respective first to nth currents (i1 to in) from the first to nth choke coils (C1 to Cn) of the current generator 214, and a detailed description thereof will thus be omitted.

Figure 7:
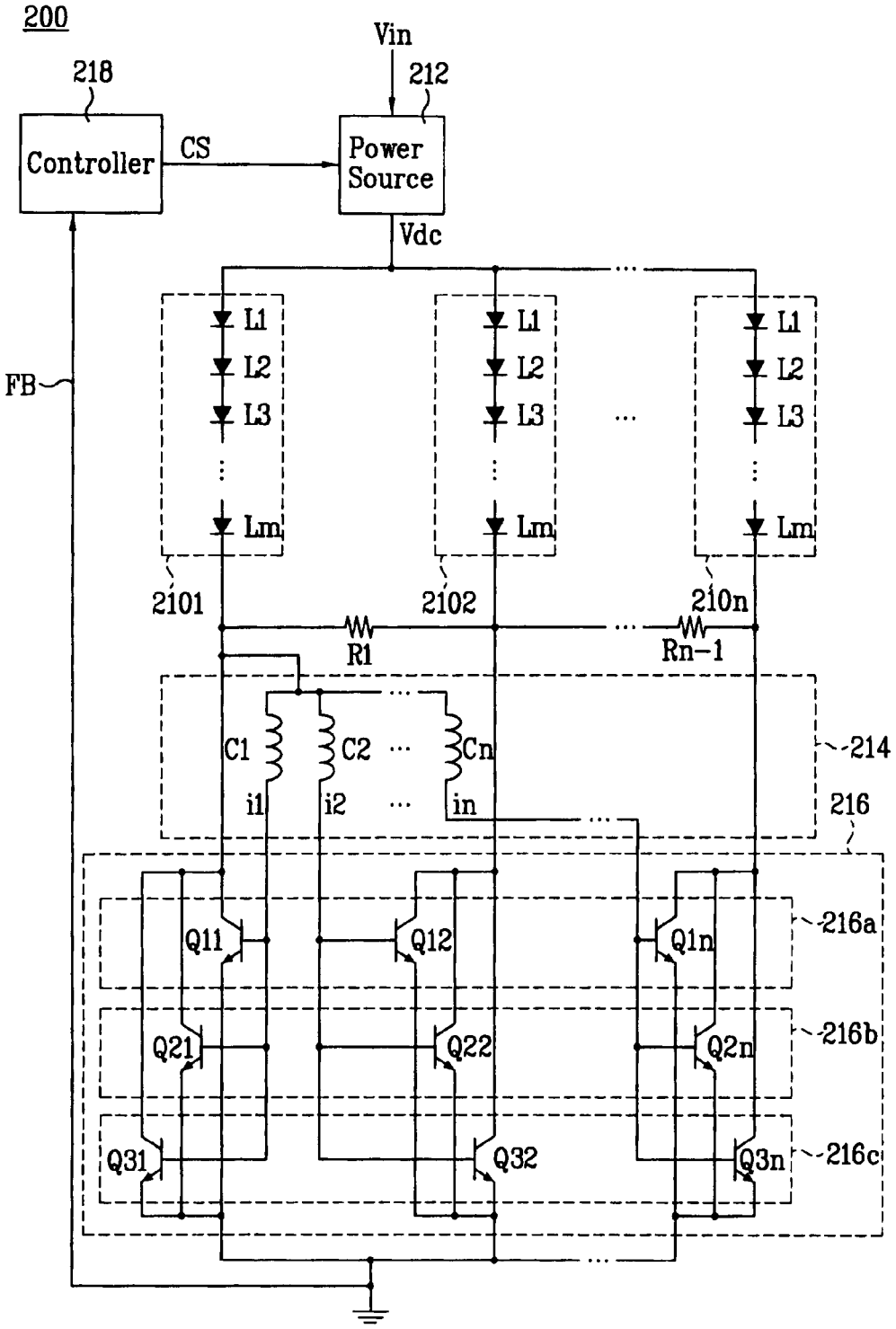
FIG. 7 is a schematic view of another embodiment of the backlight driving apparatus according to the second embodiment.

As another alternative, the backlight driving apparatus 200 according to the second embodiment shown in FIG. 6 may further include first to (n−1)th resistors (R1 to Rn−1) disposed between the LED arrays 2101 to 210*n* and the current generator 214 and each connected between the other ends of adjacent the LED arrays 2101 to 210*n*, as shown in FIG. 7.

Each of the first to (n−1)th resistors (R1 to Rn−1) is connected between the other ends of the adjacent LED arrays to equalize the base voltage and collector voltage of each of the mirror transistors (Q1 to Qn), thereby satisfying the ideal current mirror formula as in the above-stated equation 1.

Figure 8:
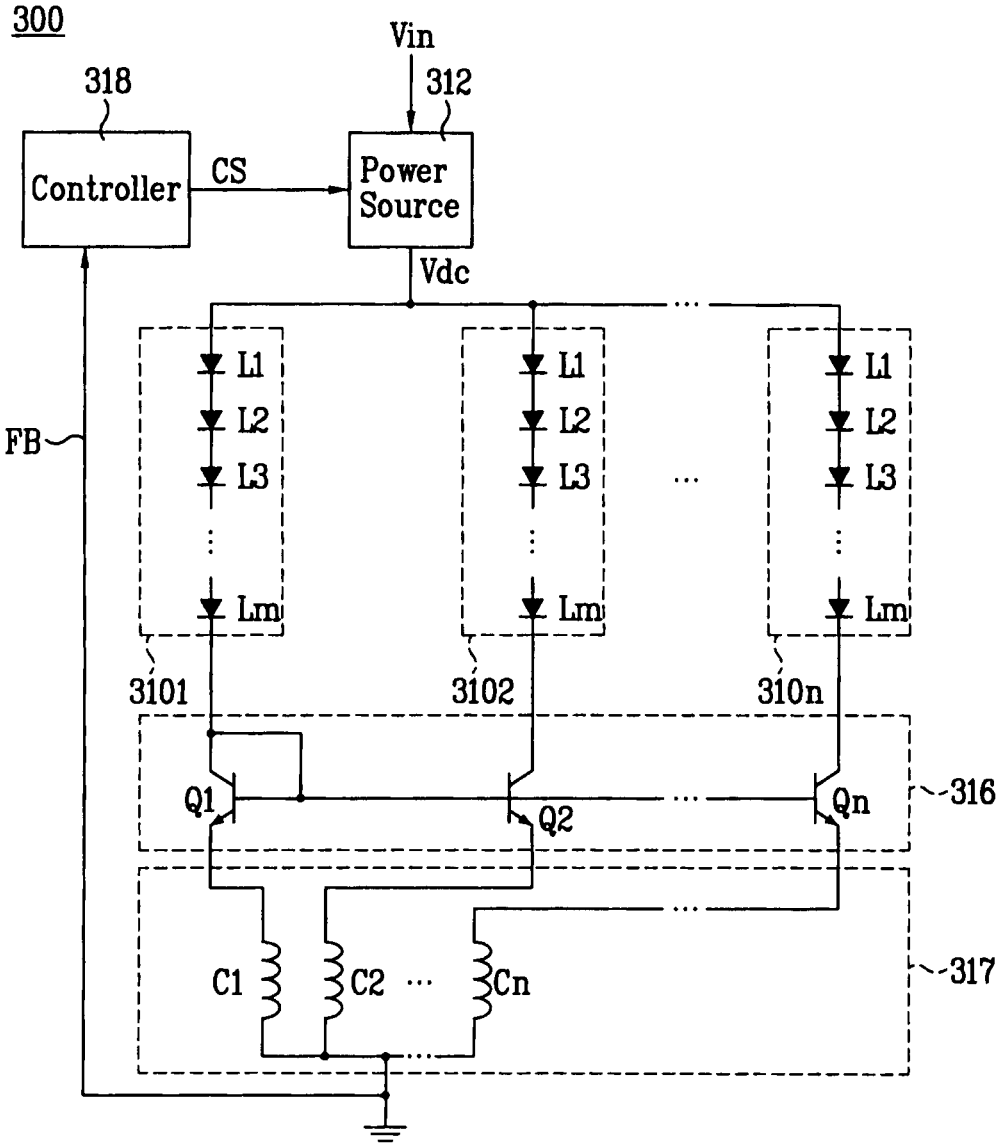
FIG. 8 is a schematic view of an embodiment of a backlight driving apparatus according to a third embodiment.

FIG. 8 is a schematic view of an embodiment of a backlight driving apparatus according to a third embodiment.

Referring to FIG. 8, the backlight driving apparatus 300 according to the third embodiment includes first to nth LED arrays 3101 to 310*n* each including a plurality of LEDs (L1 to Lm) connected in series, a power source 312 for generating a driving current Vdc and supplying the generated driving current Vdc in common to the first to nth LED arrays 3101 to 310*n*, a current mirror circuit 316 connected to the LED arrays 3101 to 310*n* for allowing the same amount of currents to flow respectively through the LED arrays 3101 to 310*n*, a current compensator 317 connected to the current mirror circuit 316 for compensating for a difference among the amounts of currents flowing respectively through the LED arrays 3101 to 310*n*, and a controller 318 for controlling the power source 312 based on a feedback signal outputted from the current compensator 317.

The power source 312 generates the driving current Vdc using an input voltage Vin in response to a control signal CS from the controller 318.

The plurality of LEDs (L1 to Lm) of each of the LED arrays 3101 to 310*n* are connected in series between an output terminal of the power source 312 and the current mirror circuit 316. Here, the anode terminals of the first LEDs L1 of the LED arrays 3101 to 310*n* are connected in common to the output terminal of the power source 312. The LEDs (L1 to Lm) of each LED array are lighted by the driving current Vdc from the power source 312.

The current mirror circuit 316 includes first to nth mirror transistors (Q1 to Qn) for equalizing the amounts of currents flowing respectively through the LED arrays 3101 to 310*n* based on the current flowing through the first LED array 3101.

The base terminals of the first to nth mirror transistors (Q1 to Qn) are connected in common to the other end of the first LED array 3101. The collector terminals of the first to nth mirror transistors (Q1 to Qn) are connected to the other ends of the LED arrays 3101 to 310*n*, respectively. The emitter terminals of the first to nth mirror transistors (Q1 to Qn) are connected to the current compensator 317. Preferably, the first to nth mirror transistors (Q1 to Qn) are formed by the same process such that they have the same size and the same channel aspect ratio W/L to form a current mirror.

These first to nth mirror transistors (Q1 to Qn) are turned on by the current flowing through the first LED array 3101 to equalize the amounts of the currents flowing respectively through the LED arrays 3101 to 310*n*.

The current compensator 317 includes first to nth choke coils (C1 to Cn) having one ends connected respectively to the emitter terminals of the mirror transistors (Q1 to Qn) of the current mirror circuit 316 and the other ends connected in common to the ground voltage source.

The first to nth choke coils (C1 to Cn) compensate for a difference among the amounts of the currents flowing respectively through the LED arrays 3101 to 310*n* based respectively on currents flowing respectively through the mirror transistors (Q1 to Qn). To this end, the first to nth choke coils (C1 to Cn) may have the same turn ratio or different turn ratios to equalize the amounts of currents (i1 to in) flowing respectively through the first to nth mirror transistors (Q1 to Qn). Therefore, the current compensator 317 prevents, based on the turn ratios of the choke coils (C1 to Cn), the currents (i1 to in) flowing respectively through the first to nth mirror transistors (Q1 to Qn) from varying due to disturbance.

The controller 318 generates a control signal (CS) to control the power source 312 by the feedback of current flowing to the ground voltage source from each of the first to nth choke coils (C1 to Cn) through a feedback line FB connected in common to the other ends of the first to nth choke coils (C1 to Cn), and controls the current flowing to the respective LED arrays 3101 to 310*n* to a constant value. As a result, the driving current Vdc from the power source 312 varies with the control signal CS from the controller 318.

As described above, the backlight driving apparatus 300 according to the third embodiment can drive the plurality of LED arrays 3101 to 310*n* with one controller 318 and one power source 312 by supplying currents to the LED arrays 3101 to 310*n*, respectively, using the mirror transistors (Q1 to Qn) and the choke coils (C1 to Cn).

Therefore, the backlight driving apparatus 300 according to the third embodiment is capable of simplifying the circuit configuration to drive the plurality of LED arrays 3101 to 310*n* and making the current balance of the LED arrays 3101 to 310*n* uniform.

Figure 9:
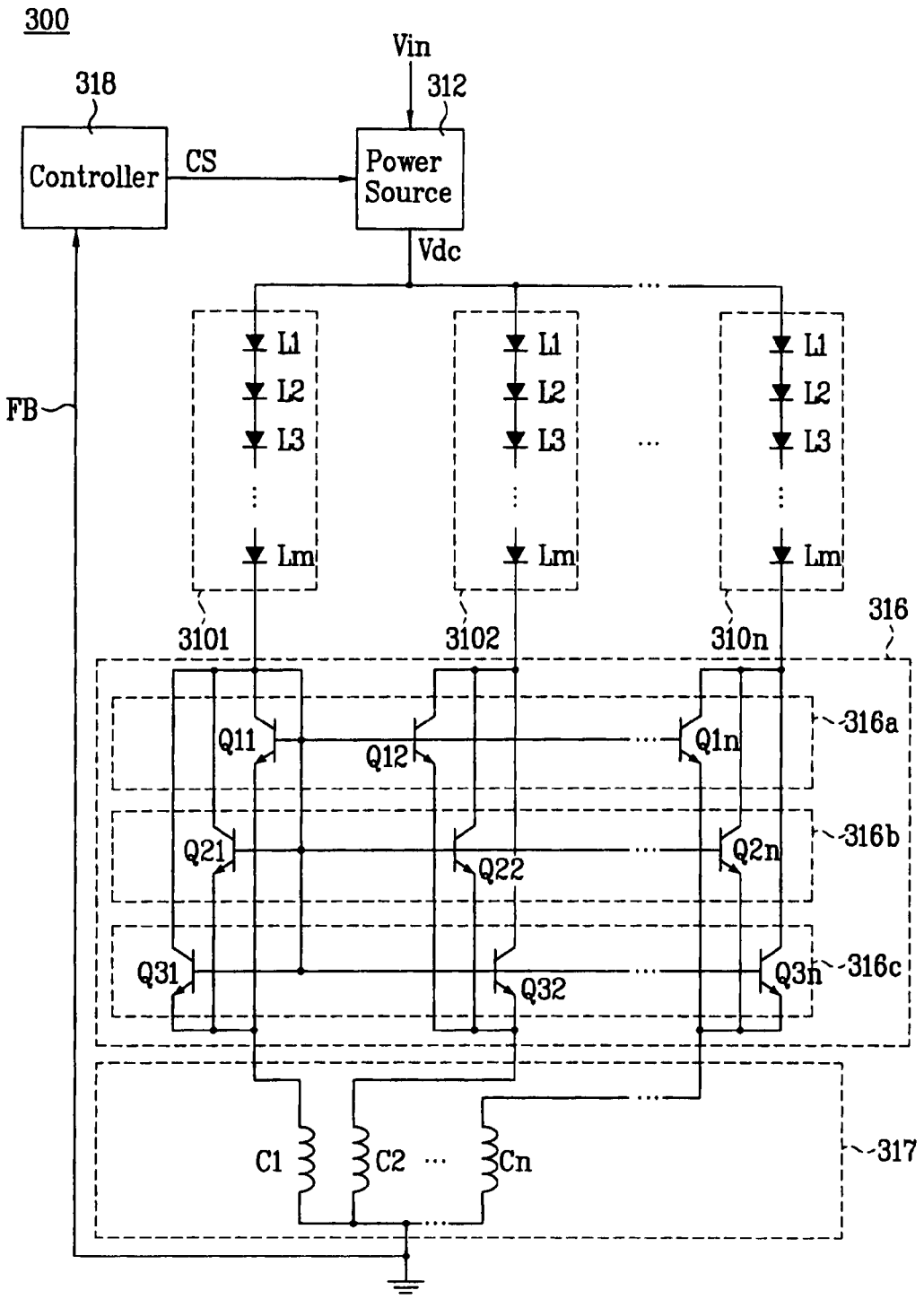
FIG. 9 is a schematic view of another embodiment of the backlight driving apparatus according to the third embodiment.

Alternatively, in the backlight driving apparatus 300 according to the third embodiment, the current mirror circuit 316 may include first to third current mirrors 316*a*, 316*b* and 316*c* connected between the LED arrays 3101 to 310*n* and the ground voltage source, as shown in FIG. 9.

The first to third current mirrors 316*a*, 316*b* and 316*c* are the same in configuration as the first to third current mirrors 116*a*, 116*b* and 116*c* shown in FIG. 3, and a detailed description thereof will thus be omitted.

Figure 10:
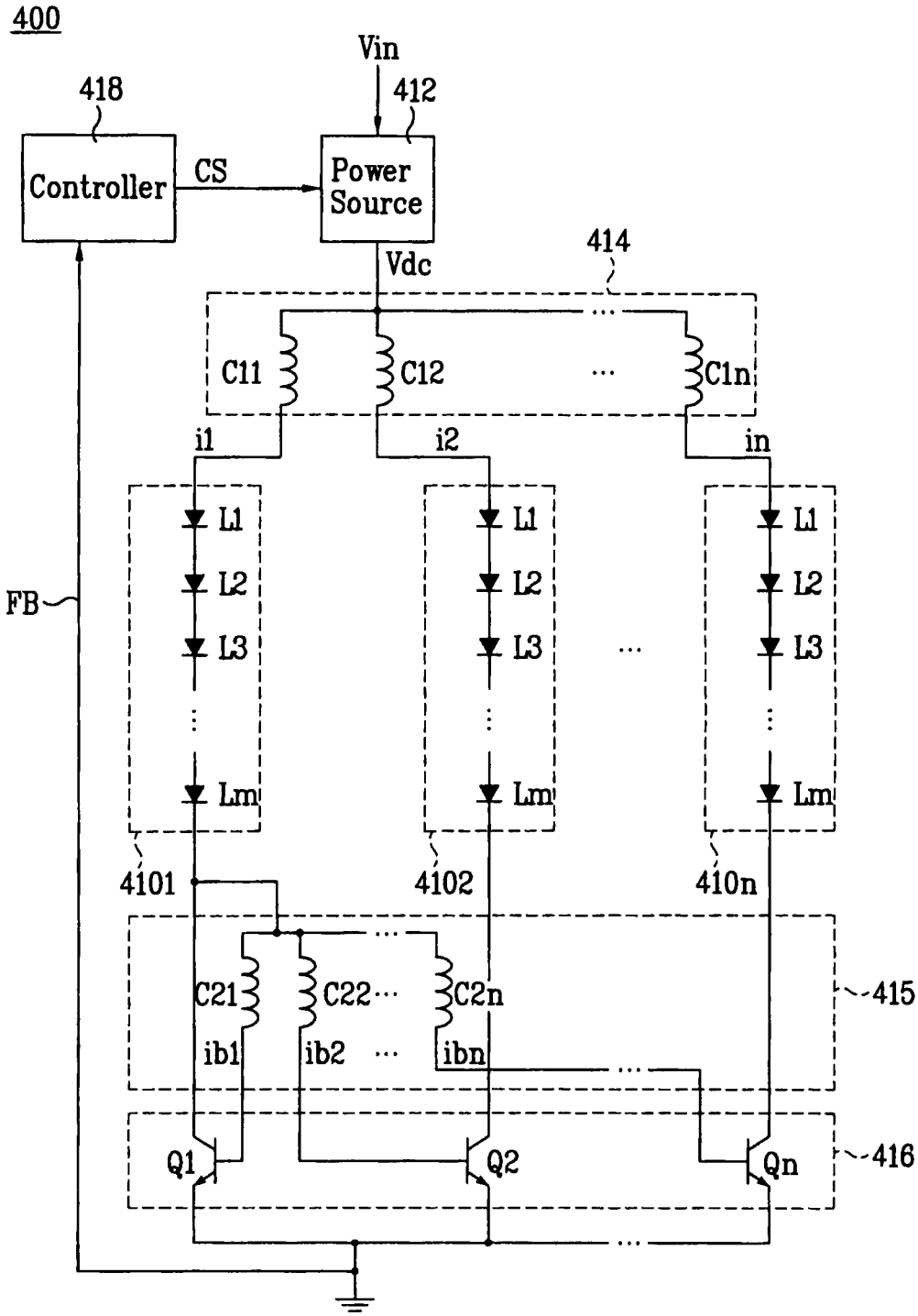
FIG. 10 is a schematic view of an embodiment of a backlight driving apparatus according to a fourth embodiment.

FIG. 10 is a schematic view of an embodiment of a backlight driving apparatus according to a fourth embodiment.

Referring to FIG. 10, the backlight driving apparatus 400 according to the fourth embodiment includes first to nth LED arrays 4101 to 410*n* each including a plurality of LEDs (L1 to Lm) connected in series, a power source 412 for generating a driving current Vdc, a current generator 414 for generating first to nth currents (i1 to in) to drive respectively the LED arrays 4101 to 410*n* using the driving current Vdc, a base current generator 415 for generating first to nth base currents ib1 to ibn using the current i1 from the first LED array 4101, a current mirror circuit 416 for allowing the same amount of currents to flow respectively through the LED arrays 4101 to 410*n* based respectively on the first to nth base currents ib1 to ibn, and a controller 418 for controlling the power source 412 based on a feedback signal outputted from the current mirror circuit 416.

The power source 412 generates the driving current Vdc using an input voltage Vin in response to a control signal CS from the controller 418.

The current generator 414 includes n first choke coils (C11 to C1*n*) connected in common to an output terminal of the power source 412 and respectively to one ends of the LED arrays 4101 to 410*n*.

The n first choke coils (C11 to C1*n*) may have the same turn ratio or different turn ratios to supply the same amount of currents to the LED arrays 4101 to 410*n*, respectively.

With this configuration, the current generator 414 supplies the first to nth currents (i1 to in) which are the same in amount, respectively, to the LED arrays 4101 to 410*n* by compensating for an impedance difference among the LED arrays 4101 to 410*n* using the n first choke coils (C11 to C1*n*).

The plurality of LEDs (L1 to Lm) of each of the LED arrays 4101 to 410*n* are connected in series between the first choke coils (C11 to C1*n*) of the current generator 414 and the current mirror circuit 416. The LEDs (L1 to Lm) of each LED array are lighted by the currents (i1 to in) from the current generator 414.

The base current generator 415 includes n second choke coils (C21 to C2*n*) connected in common to the other end of the first LED array 4101 and connected to the current mirror circuit 416.

The n second choke coils (C21 to C2*n*) generate the first to nth base currents ib1 to ibn based on the current i1 flowing through the first LED array 4101, respectively.

The current mirror circuit 416 includes first to nth mirror transistors (Q1 to Qn) for equalizing the amounts of currents flowing respectively through the LED arrays 4101 to 410*n* based respectively on the first to nth base currents ib1 to ibn supplied from the base current generator 415.

The base terminals of the first to nth mirror transistors (Q1 to Qn) are connected to the n second choke coils (C21 to C2*n*) of the base current generator 415, respectively. The collector terminals of the first to nth mirror transistors (Q1 to Qn) are connected to the other ends of the LED arrays 4101 to 410*n*, respectively. The emitter terminals of the first to nth mirror transistors (Q1 to Qn) are connected in common to the ground voltage source. Preferably, the first to nth mirror transistors (Q1 to Qn) are formed by the same process such that they have the same size and the same channel aspect ratio W/L to form a current mirror.

These first to nth mirror transistors (Q1 to Qn) are turned on by the first to nth base currents ib1 to ibn from the base current generator 415, respectively, to equalize the amounts of currents flowing respectively through the LED arrays 4101 to 410*n*.

On the other hand, the second choke coils (C21 to C2*n*) of the base current generator 415 may have the same turn ratio or different turn ratios to equalize the amounts of the currents (i1 to in) flowing respectively to the mirror transistors (Q1 to Qn). Therefore, the base current generator 415 generates the first to nth base currents ib1 to ibn based on the turn ratios of the second choke coils (C21 to C2*n*), so as to prevent the currents (i1 to in) flowing respectively to the mirror transistors (Q1 to Qn) from varying due to disturbance.

The controller 418 generates a control signal (CS) to control the power source 412 by the feedback of current flowing to the ground voltage source from each of the first to nth mirror transistors (Q1 to Qn) through a feedback line FB connected in common to the emitter terminals of the first to nth mirror transistors (Q1 to Qn), and controls the current flowing to the respective LED arrays 4101 to 410*n* to a constant value. As a result, the driving current Vdc from the power source 412 varies with the control signal CS from the controller 418.

As described above, the backlight driving apparatus 400 according to the fourth embodiment can drive the plurality of LED arrays 4101 to 410*n* with one controller 418 and one power source 412 by supplying currents to the LED arrays 4101 to 410*n*, respectively, using the choke coils (C11 to C1*n*) and (C21 to C2*n*) and the mirror transistors (Q1 to Q*n*).

Therefore, the backlight driving apparatus 400 according to the fourth embodiment is capable of simplifying the circuit configuration to drive the plurality of LED arrays 4101 to 410*n* and making the current balance of the LED arrays 4101 to 410*n* uniform.

Figure 11:
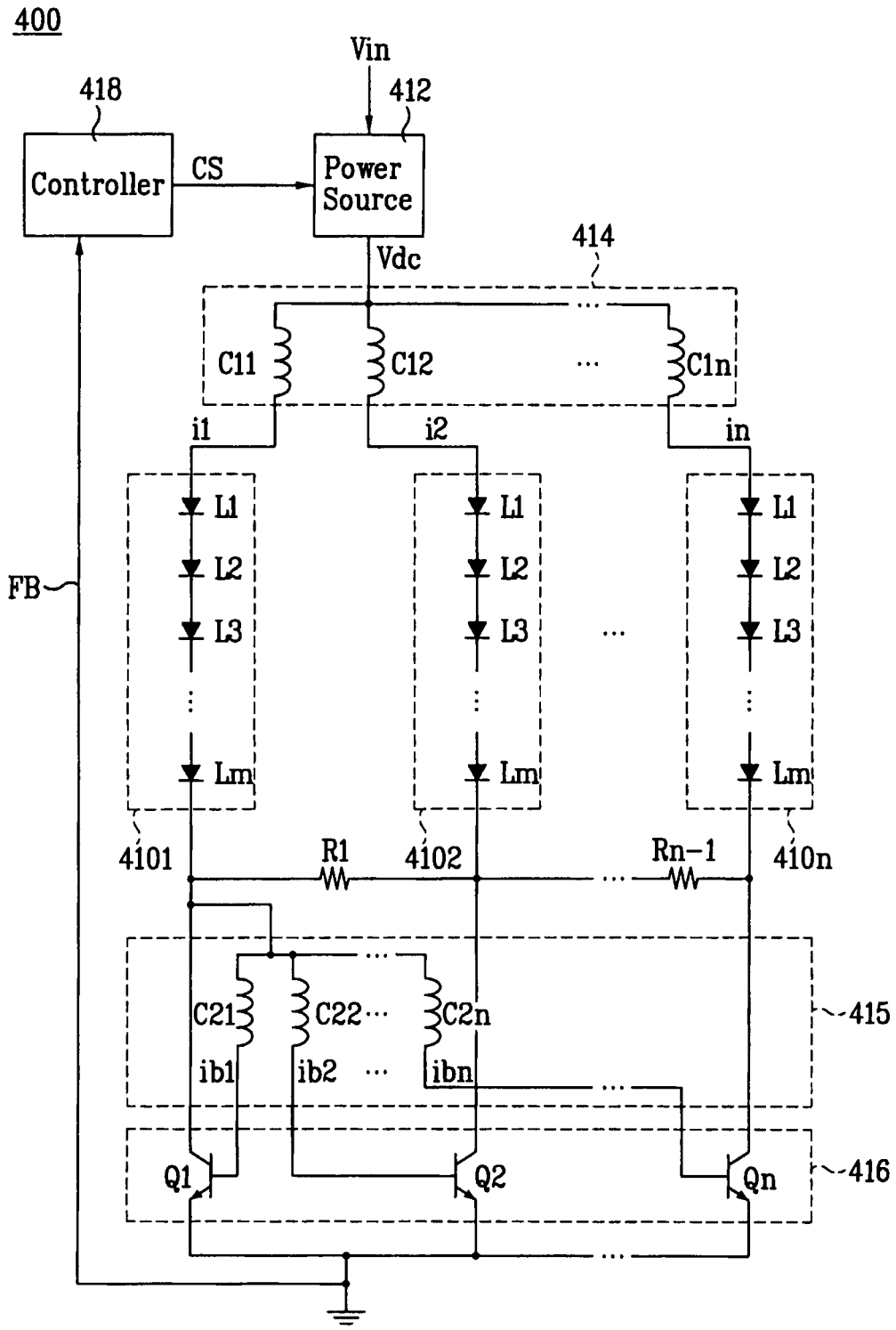
FIG. 11 is a schematic view of another embodiment of the backlight driving apparatus according to the fourth embodiment.

Alternatively, the backlight driving apparatus 400 according to the fourth embodiment may further include first to (n−1)th resistors (R1 to Rn−1) disposed between the LED arrays 4101 to 410*n* and the base current generator 415 and each connected between the other ends of adjacent the LED arrays 4101 to 410*n*, as shown in FIG. 11.

Each of the first to (n−1)th resistors (R1 to Rn−1) is connected between the other ends of the adjacent LED arrays to equalize the base voltage and collector voltage of each of the mirror transistors (Q1 to Qn), thereby satisfying the ideal current mirror formula as in the above-stated equation 1.

Figure 12:
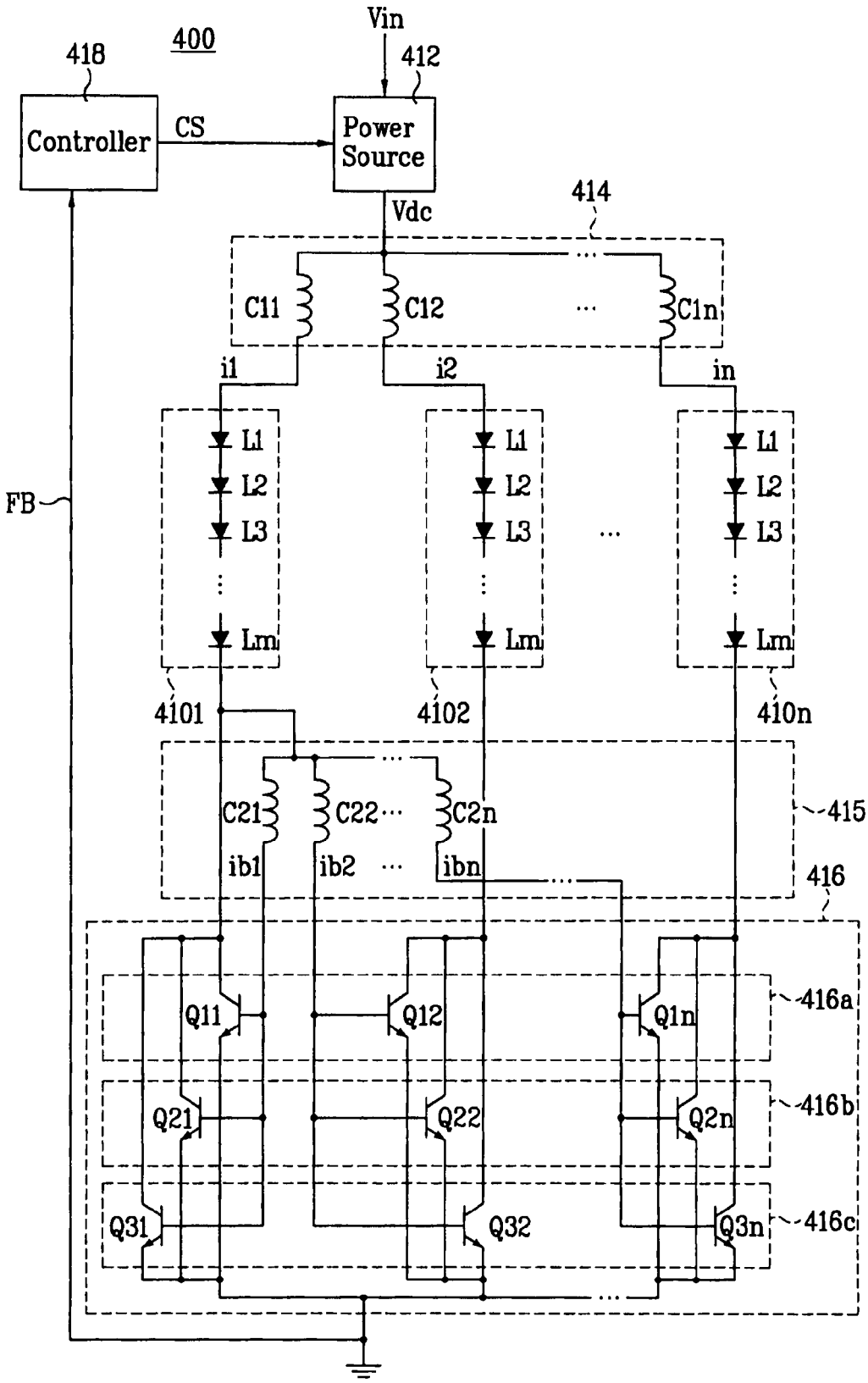
FIG. 12 is a schematic view of another embodiment of the backlight driving apparatus according to the fourth embodiment.

As another alternative, in the backlight driving apparatus 400 according to the fourth embodiment shown in FIG. 10, the current mirror circuit 416 may include first to third current mirrors 416*a*, 416*b* and 416*c* connected between the LED arrays 4101 to 410*n* and the ground voltage source, as shown in FIG. 12.

The first to third current mirrors 416*a*, 416*b* and 416*c* are the same in configuration as the first to third current mirrors 216*a*, 216*b* and 216*c* shown in FIG. 6, and a detailed description thereof will thus be omitted.

Figure 13:
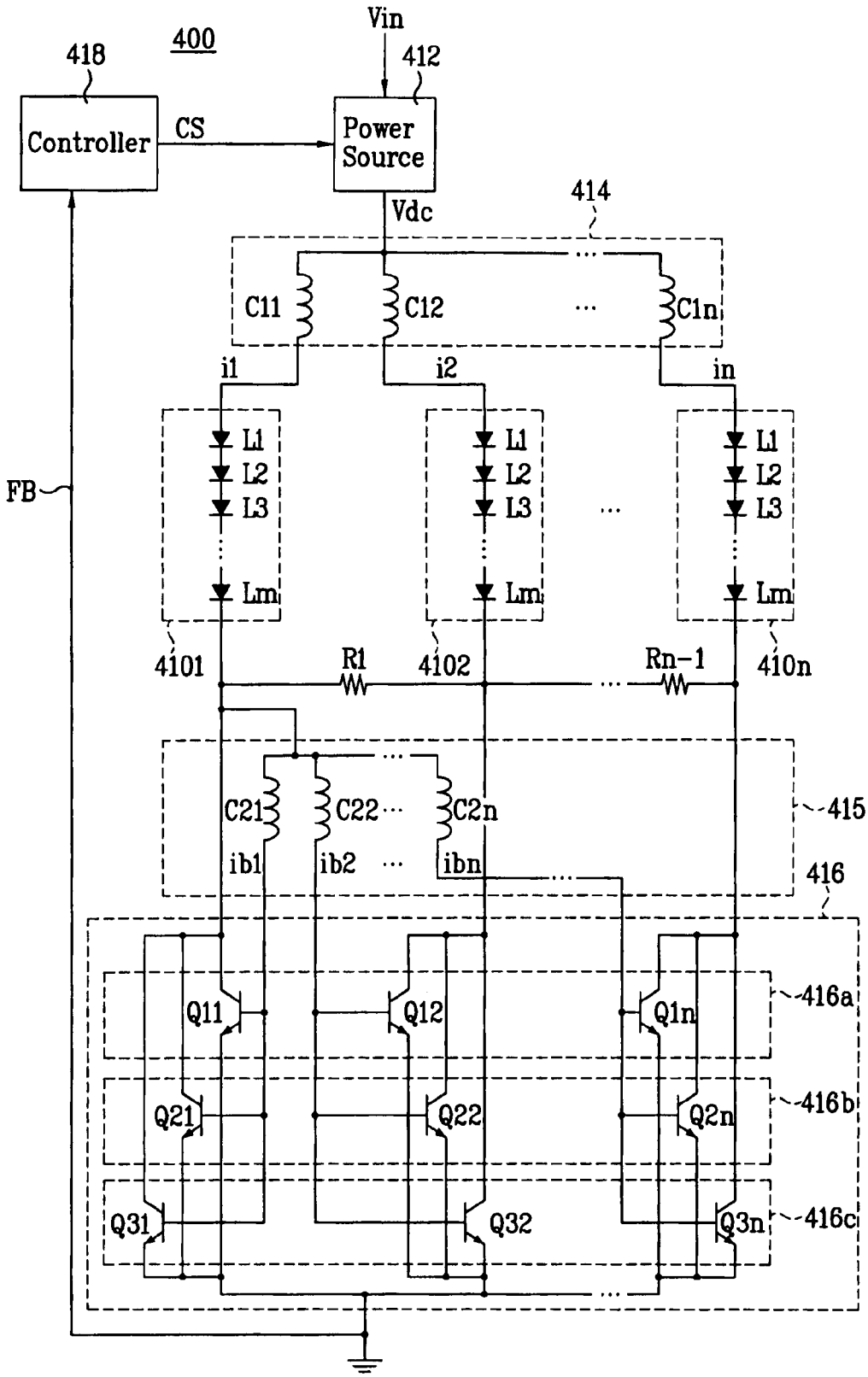
FIG. 13 is a schematic view of another embodiment of the backlight driving apparatus according to the fourth embodiment.

As another alternative, the backlight driving apparatus 400 according to the fourth embodiment shown in FIG. 12 may further include first to (n−1)th resistors (R1 to Rn−1) disposed between the LED arrays 4101 to 410*n* and the base current generator 415 and each connected between the other ends of adjacent the LED arrays 4101 to 410*n*, as shown in FIG. 13.

Each of the first to (n−1)th resistors (R1 to Rn−1) is connected between the other ends of the adjacent LED arrays to equalize the base voltage and collector voltage of each of the mirror transistors (Q1 to Qn), thereby satisfying the ideal current mirror formula as in the above-stated equation 1.

Figure 14:
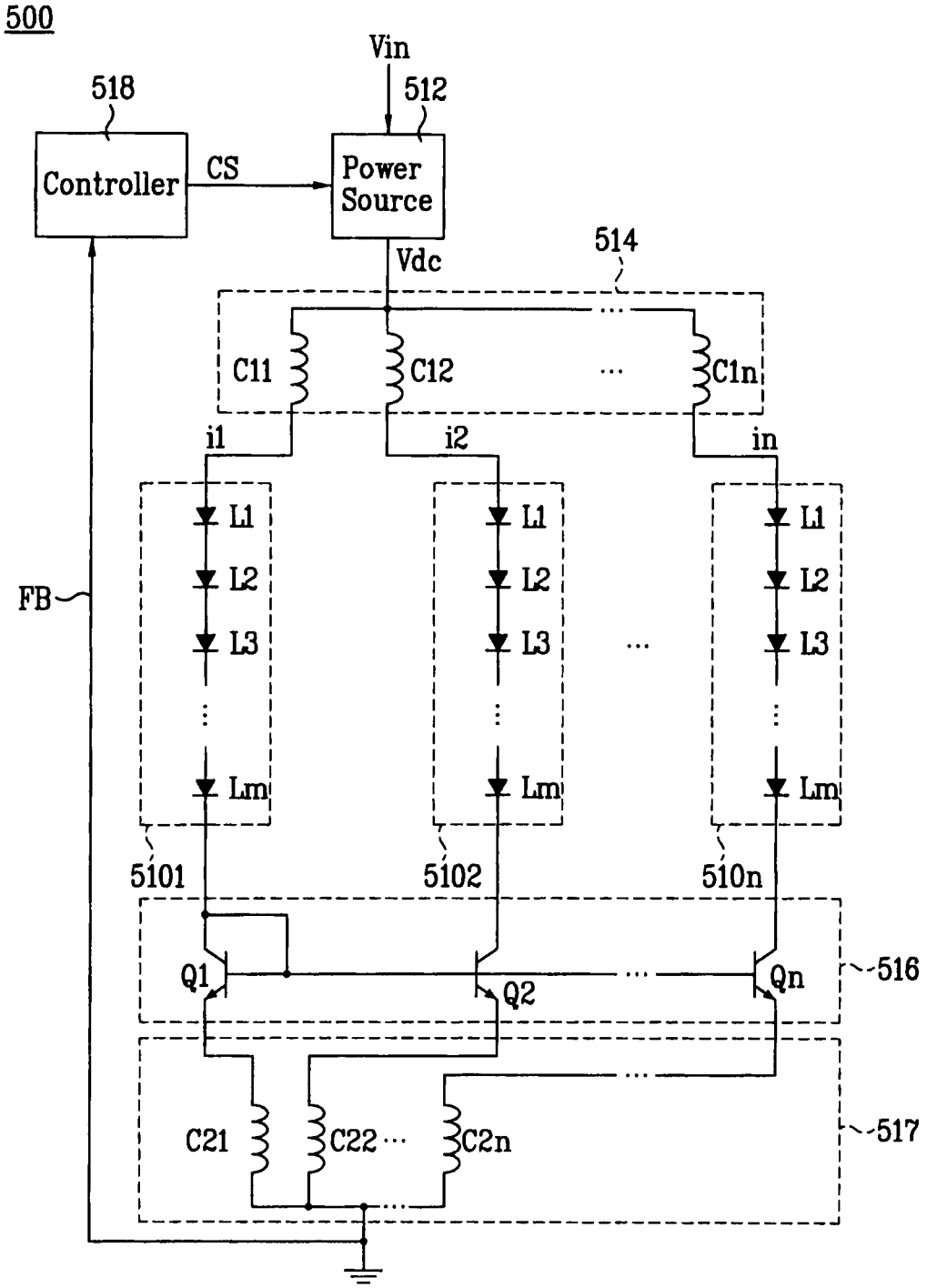
FIG. 14 is a schematic view of an embodiment of a backlight driving apparatus according to a fifth embodiment.

FIG. 14 is a schematic view of an embodiment of a backlight driving apparatus according to a fifth embodiment.

Referring to FIG. 14, the backlight driving apparatus 500 according to the fifth embodiment includes first to nth LED arrays 5101 to 510*n* each including a plurality of LEDs (L1 to Lm) connected in series, a power source 512 for generating a driving current Vdc, a current generator 514 for generating first to nth currents (i1 to in) to drive the LED arrays 5101 to 510*n* using the driving current Vdc, respectively, a current mirror circuit 516 connected to the LED arrays 5101 to 510*n* for allowing the same amount of currents to flow respectively through the LED arrays 5101 to 510*n*, a current compensator 517 connected to the current mirror circuit 516 for compensating for a difference among the amounts of currents flowing respectively through the LED arrays 5101 to 510*n*, and a controller 518 for controlling the power source 512 based on a feedback signal outputted from the current compensator 517.

The power source 512 generates the driving current Vdc using an input voltage Vin in response to a control signal CS from the controller 518.

The current generator 514 includes n first choke coils (C11 to C1*n*) connected in common to an output terminal of the power source 512 and respectively to one ends of the LED arrays 5101 to 510*n*.

The n first choke coils (C11 to C1*n*) may have the same turn ratio or different turn ratios to supply the same amount of currents to the LED arrays 5101 to 510*n*, respectively.

With this configuration, the current generator 514 supplies the first to nth currents (i1 to in) which are the same in amount, respectively, to the LED arrays 5101 to 510*n* by compensating for an impedance difference among the LED arrays 5101 to 510*n* using the n first choke coils (C11 to C1*n*).

The plurality of LEDs (L1 to Lm) of each of the LED arrays 5101 to 510*n* are connected in series between the first choke coils (C11 to C1*n*) of the current generator 514 and the current mirror circuit 516. The LEDs (L1 to Lm) of each LED array are lighted by the currents (i1 to in) from the current generator 514.

The current mirror circuit 516 includes first to nth mirror transistors (Q1 to Qn) for equalizing the amounts of currents flowing respectively through the LED arrays 5101 to 510*n* based on the current flowing through the first LED array 5101.

The base terminals of the first to nth mirror transistors (Q1 to Qn) are connected in common to the other end of the first LED array 5101. The collector terminals of the first to nth mirror transistors (Q1 to Qn) are connected to the other ends of the LED arrays 5101 to 510*n*, respectively. The emitter terminals of the first to nth mirror transistors (Q1 to Qn) are connected to the current compensator 517. Preferably, the first to nth mirror transistors (Q1 to Qn) are formed by the same process such that they have the same size and the same channel aspect ratio W/L to form a current mirror.

These first to nth mirror transistors (Q1 to Qn) are turned on by the current flowing through the first LED array 5101 to equalize the amounts of the currents flowing respectively through the LED arrays 5101 to 510*n*.

The current compensator 517 includes n second choke coils (C21 to C2*n*) having one ends connected respectively to the emitter terminals of the mirror transistors (Q1 to Qn) of the current mirror circuit 516 and the other ends connected in common to the ground voltage source.

The n second choke coils (C21 to C2*n*) compensate for a difference among the amounts of the currents flowing respectively through the LED arrays 5101 to 510*n* based respectively on currents flowing respectively through the mirror transistors (Q1 to Qn). To this end, the n second choke coils (C21 to C2*n*) may have the same turn ratio or different turn ratios to equalize the amounts of currents (i1 to in) flowing respectively through the first to nth mirror transistors (Q1 to Qn). Therefore, the current compensator 517 prevents, based on the turn ratios of the second choke coils (C21 to C2*n*), the currents (i1 to in) flowing respectively through the first to nth mirror transistors (Q1 to Qn) from varying due to disturbance.

The controller 518 generates a control signal (CS) to control the power source 512 by the feedback of current flowing to the ground voltage source from each of second choke coils (C21 to C2*n*) through a feedback line FB connected in common to the other ends of the second choke coils (C21 to C2*n*), and controls the current flowing to the respective LED arrays 5101 to 510*n* to a constant value. As a result, the driving current Vdc from the power source 512 varies with the control signal CS from the controller 518.

As described above, the backlight driving apparatus 500 according to the fifth embodiment can drive the plurality of LED arrays 5101 to 510*n* with one controller 518 and one power source 512 by supplying currents to the LED arrays 5101 to 510*n*, respectively, using the choke coils (C11 to C1*n*) and (C21 to C2*n*) and the mirror transistors (Q1 to Qn).

Therefore, the backlight driving apparatus 500 according to the fifth embodiment is capable of simplifying the circuit configuration to drive the plurality of LED arrays 5101 to 510*n* and making the current balance of the LED arrays 5101 to 510*n* uniform.

Figure 15:
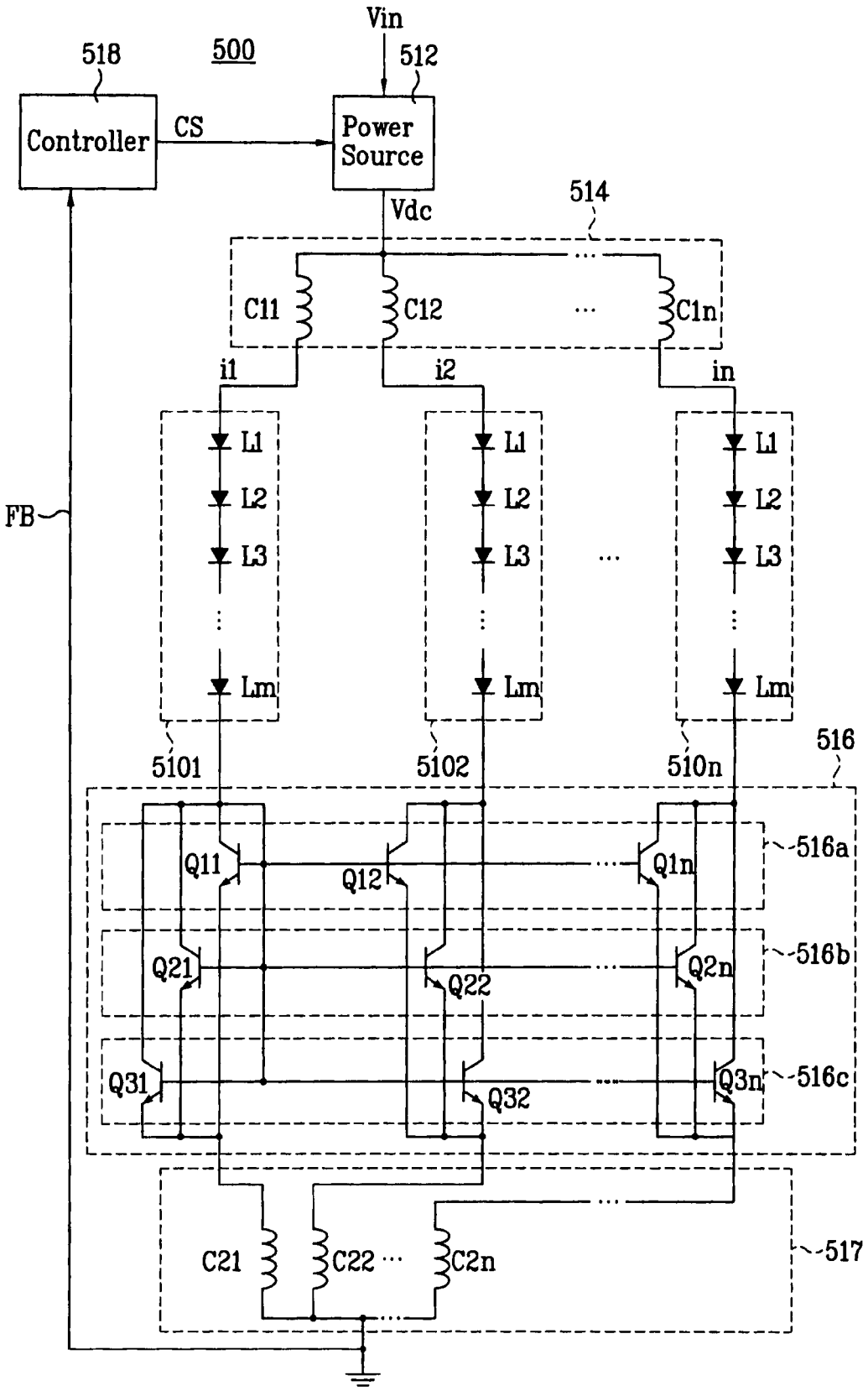
FIG. 15 is a schematic view of another embodiment of the backlight driving apparatus according to the fifth embodiment.

Alternatively, in the backlight driving apparatus 500 according to the fifth embodiment, the current mirror circuit 516 may include first to third current mirrors 516*a*, 516*b* and 516*c* connected between the LED arrays 5101 to 510*n* and the ground voltage source, as shown in FIG. 15.

The first to third current mirrors 516*a*, 516*b* and 516*c* are the same in configuration as the first to third current mirrors 116*a*, 116*b* and 116*c* shown in FIG. 3, and a detailed description thereof will thus be omitted.

These backlight driving apparatuses according to the first to fifth embodiments can be used as light sources for liquid crystal displays.

As apparent from the above description, a backlight driving apparatus according to the present invention can drive a plurality of LED arrays with one controller and one power source by supplying currents to the LED arrays, respectively, using a current generator including choke coils and a current mirror circuit including mirror transistors.

Therefore, the present invention has the effect of simplifying a circuit configuration to drive the plurality of LED arrays and making the current balance of the LED arrays uniform.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A backlight driving apparatus comprising:

a plurality of light emitting diode arrays including a plurality of light emitting diodes connected in series;

a power source for generating a driving current;

a current generator for generating currents to drive the light emitting diode arrays using the driving current, respectively, wherein the current generator comprises a plurality of first choke coils connected between the power source and the light emitting diode arrays and compensates for an impedance difference between the light emitting diode arrays;

a base current generator for generating a plurality of base currents using a current from any one of the light emitting diode arrays; and a current mirror circuit for allowing the same amount of currents to flow respectively through the light emitting diode arrays based respectively on the base currents, wherein the base current generator comprises a plurality of second choke coils connected between any one of the light emitting diode arrays and the current mirror circuit, wherein a plurality of second choke coils:

generate the plurality of base currents based on a first current flowing through the any one the light emitting diode arrays, respectively supply the plurality of base currents to a plurality of base terminals as control terminals of transistors of the current mirror circuit, have a plurality of first terminals which are commonly connected with the any one of the light emitting diode arrays, and have a plurality of second terminals which are respectively connected with the plurality of base terminals of transistors of the current mirror circuit.

2. The backlight driving apparatus according to claim 1, further comprising a plurality of resistors disposed between the light emitting diode arrays and the base current generator and each connected between adjacent the light emitting diode arrays.

3. The backlight driving apparatus according to claim 1, wherein the first choke coils of the current generator have first terminals connected in common to an output terminal of the power source and second terminals connected respectively to the light emitting diode arrays.

4. The backlight driving apparatus according to claim 3, wherein the first choke coils have the same turn ratio or different turn ratios and the second choke coils have the same turn ratio or different ratios.

5. The backlight driving apparatus according to claim 1, wherein the current mirror circuit comprises a plurality of mirror transistors controlled by the base currents from the second choke coils, respectively, and each connected between light emitting diode arrays and a ground voltage source.

6. The backlight driving apparatus according to claim 5, further comprising a controller for controlling the power source based on feedback of the current flowing to the ground voltage source from each of the mirror transistors.

7. The backlight driving apparatus according to claim 1, wherein the current mirror circuit comprises:

a first current mirror including a plurality of first mirror transistors controlled by the base currents from the second choke coils, respectively, and each connected between the light emitting diode arrays and the ground voltage source;

a second current mirror including a plurality of second mirror transistors controlled by the base currents from the second choke coils, respectively, and connected in parallel to the n first mirror transistors, respectively; and a third current mirror including a plurality of transistors controlled by the base currents from the second choke coils, respectively, and connected in parallel to the n first and second mirror transistors, respectively.

* * * * *